United States Patent [19]

Benson

[11] 4,037,336

[45] July 26, 1977

[54] SCRAPER DEVICE HAVING RECEPTACLE WALLS HEATED BY ENGINE EXHAUST

[76] Inventor: Robert D. Benson, Arvilla, N. Dak. 58214

[21] Appl. No.: 666,608

[22] Filed: Mar. 15, 1976

[51] Int. Cl.[2] ..... E02F 3/06

[52] U.S. Cl. ..... 37/124; 298/1 H

[58] Field of Search ..... 37/124, 126 R, 126 A, 37/126 AA, 126 AB, 126 AC, 129, 12; 298/1 H

[56] References Cited

U.S. PATENT DOCUMENTS

| | | | |
|---|---|---|---|
| 2,721,097 | 10/1955 | Rittenhouse | 298/1 H |
| 2,925,301 | 2/1960 | Milligan | 37/12 X |
| 2,965,988 | 12/1960 | Monk | 37/126 R |
| 3,331,433 | 7/1967 | Hagberg | 37/12 |
| 3,472,548 | 10/1969 | Comisac | 298/1 H X |
| 3,863,367 | 2/1975 | Gee et al. | 37/126 AE X |

*Primary Examiner*—E. H. Eickholt

*Attorney, Agent, or Firm*—Robert E. Kleve

[57] ABSTRACT

This invention comprises a scraper having a front and rear frame. The rear frame has a receptacle for receiving and holding dirt with an unloading plate in the receptacle for receiving the dirt thereon. A cover plate is pivotally mounted to the front of the receptacle to open and close the receptacle. An engine is mounted on the rear frame for powering the rear frame wheels. An engine is mounted on the front frame for powering the front wheels. The receptacle has side walls with compartments in the side walls. Pipe means converts the heated exhaust from the rear engine to the compartments in the side walls. The compartment structure of each of the side walls has passageway and an outlet so that the heated exhaust leaving the rear engine must travel in the compartment structure along major portions of the side walls of the receptacle before traveling out the outlets to heat the side walls and the heat for the exhaust warms the side walls and keeps them sufficiently warm so that the ejection plate and cover plate will not freeze or lock to the side walls at the receptacle by the moisture or frost in the dirt that may lodge between the unloading plate and cover plate and the side walls of the receptacle when operating the scraper in very cold sub zero weather.

1 Claim, 7 Drawing Figures

SCRAPER DEVICE HAVING RECEPTACLE WALLS HEATED BY ENGINE EXHAUST

The invention relates to earth working equipment more particularly, the invention relates to scrapers.

It is an object of the invention to provide a novel scraper which has the compartments along the side walls of the receptacle for receiving the earth or dirt, with conduits leading from the exhaust outlet of an engine of the scraper to the compartments to carry the heated exhaust from the engine along the conduits into the compartments of the side walls of the receptacle to keep the side walls of the receptacle warm enough so that components will not freeze up and become inoperative.

It is another object of the invention to provide a novel scraper which has a receptacle for holding the earth and which has its walls heated by the exhaust from the engine of the scraper, which keeps the operative components for loading and/or unloading earth into and/or out of the receptacle from becoming inoperative.

It is another object of the invention to provide a novel scraper which can be operated in freezing weather, having a receptacle for receiving earth and an unloading plate which unloads the earth from the receptacle, and which receptacle has side walls heated by the exhaust of an engine of the scraper to keep the side walls of the receptacle sufficiently warm so that the unloading plate will not be frozen to the recepticle.

Further objects and advantages of the invention will become apparent as the description proceeds and when taken in conjunction with the accompanying drawings wherein:

FIG. 1 is a top plan view of the scrapper invention, with the receptacle of the scrapper for holding the earth having side walls with compartment passages and with conduit connections from the rear engine of the scraper leading to their passages allowing heat from the heated exhaust to heat the side walls so that the movable ejection plate and moveable front cover plate of the receptacle will not freeze or lock or become inoperative in freezing weather.

Briefly stated, the invention comprises a scraper having a front and rear frame having a pair of wheels mounted on the rear frame and a pair of wheels mounted on the front frame with a receptacle mounted on the rear frame, an engine on the rear frame and an engine on the front frame for powering the front and rear wheels, respectively, said receptacle having side walls with compartments passages therein, conduit connections from the rear engine to the compartment passages of the side walls of the receptacle, said receptacle having a movable ejection plate and a movable cover plate, with the heated exhaust from the rear engine traveling along the conduit connection into and through the compartment passages of the side walls of the receptacle to keep the side walls sufficiently warm so that the ejection plate and cover plate will not freeze to the side walls.

Figure 1:
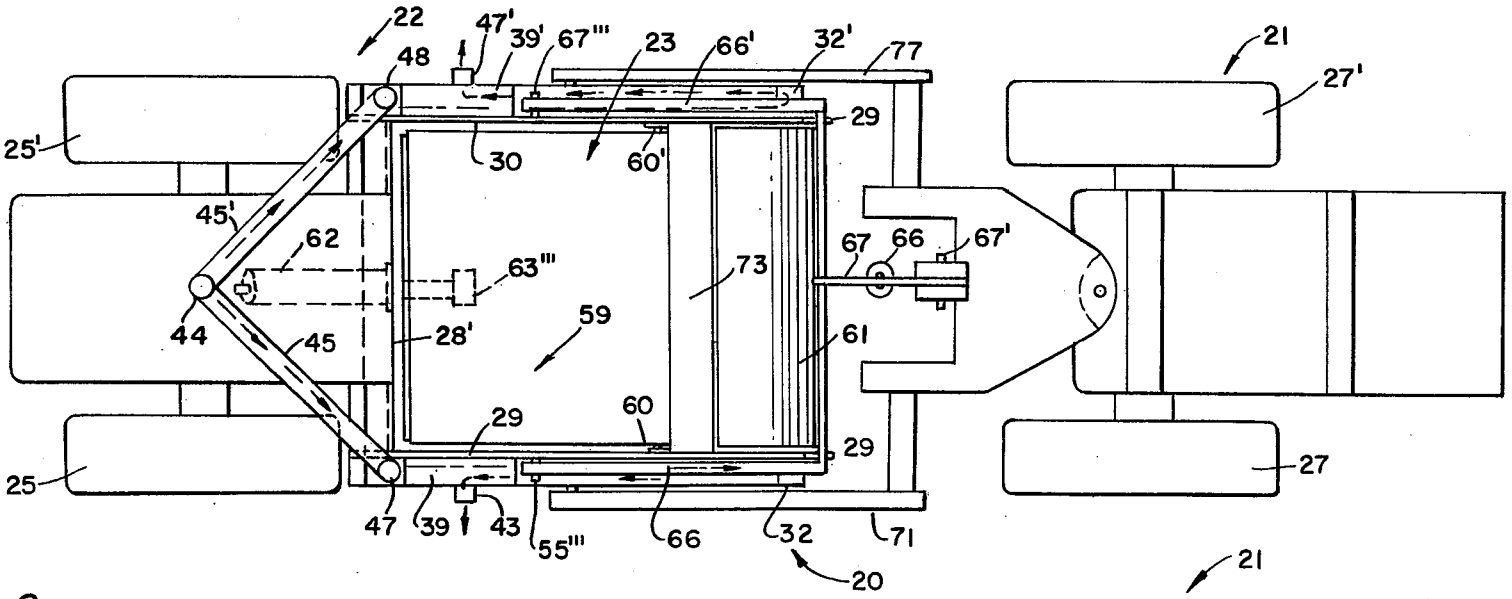
Figure 2:
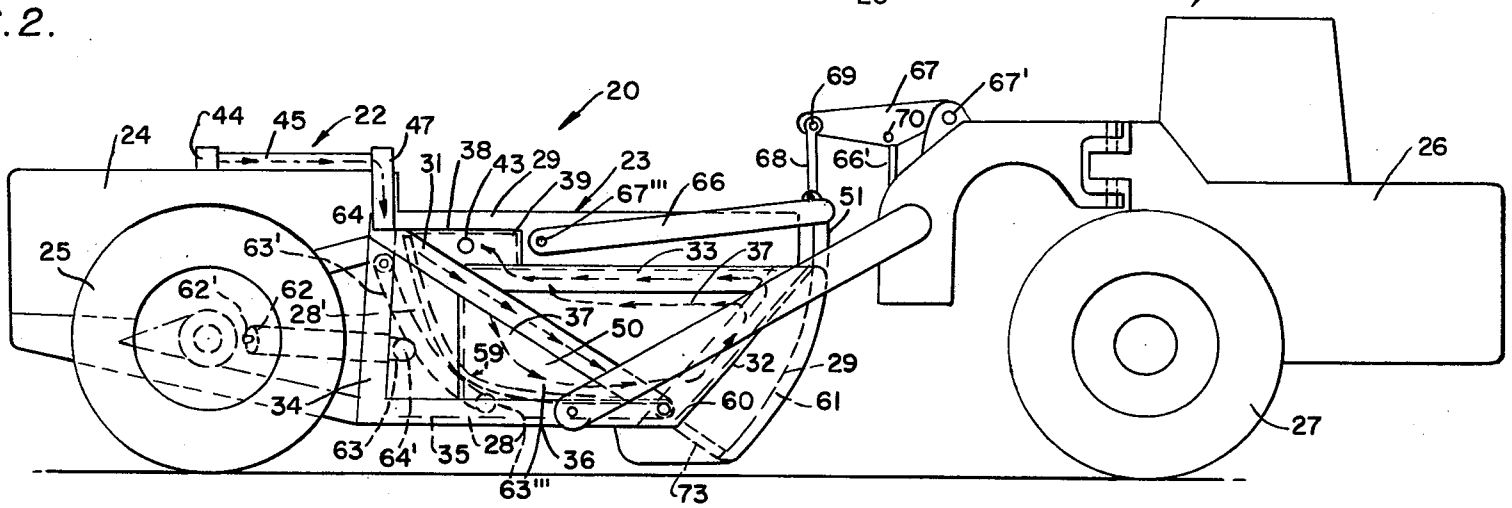
FIG. 2 is a side elevational view of the scraper invention having side walls of the receptacle of the scraper heated by the exhaust piped from the rear engine of the scraper.
Figure 5:
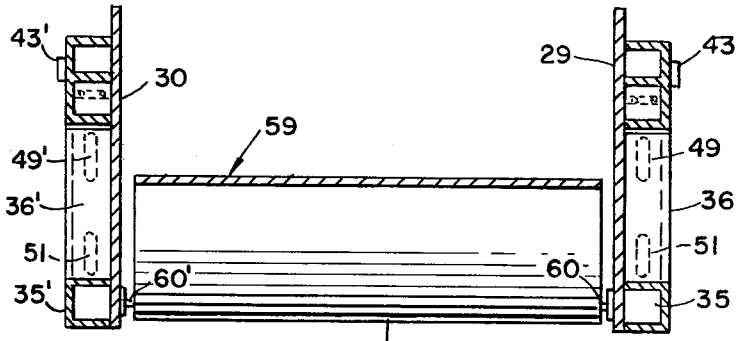
FIG. 5 is a cross-sectional view taken along line 5—5 of FIG. 4.

Referring now particularly to the drawings in FIGS. 1 and 2, the scraper invention 20 is illustrated as having a front frame 21 and a rear frame 22 with a receptacle 23 mounted onto the rear frame.

An engine 24 is mounted to the rear frame for powering the pair of wheels 25 and 25′ mounted to the rear frame and an engine 26 is mounted to the front frame for powering the front wheels 27 and 27′. The receptacle has rear beams 28 and 28′ fixed between the side walls 29 and 30.

The one side wall 29 of the receptacle 23 has steel U-shaped channel members 31, 32, 33, 34, and 35 welded to the side wall 29 and to one another to reinforce the side walls 29. A similar plurality of steel U-channel members 31′, 32′, 33′, 34′, and 35′ are fixed to the other side wall 30.

An L-shaped steel panel 36 is welded to the one side wall and welded to beams 31 and 34 to provide an enlarged compartment. A panel 37 is welded to the outside edges of beams 31, 32, and 33 to provide a compartment and a compartment 38 having side panels 39, 40, and 41 is fixed together with the edges of the side panels 39, 40, and 41 fixed to beams 32 and 33 and to the side wall 29. The panel 40 has an outlet opening 42 with a spout 43 fixed about the outlet opening 42 to provide an exhaust outlet for compartment 39.

The other side wall 30 of the receptacle 23 has an L-shaped steel panel 36′ welded to the other side wall 30 and welded to beams 31′ and 34′ to provide an enlarged compartment. A panel 37′ is welded to the outside edges of beams 31′, 32′, and 33′ to provide a compartment and a compartment 38′ having side walls 39′, 40′, and 41′ is fixed to beams 32′ and 33′ and to side walls 30. The panel 40′ has an outlet opening 42′ with a spout fixed bout the outlet opening 42′ to provide an exhaust outlet for compartment 39′.

The rear engine 24 has a vertical exhaust outlet pipe 44 and a pair of forwardly diverging pipes 45 and 45′ which communicate with the exhaust pipe 44 of the engine at their one ends. The pipe 45 connects at its other end with a verticle steel pipe 47 fixed to the side wall 29 of the receptacle and the vertical pipe 47 connects with a beam 31 on side walls 29 to provide a passageway from the rear engine 24 through exhaust pipe 44 through pipe 45 and pipe 47 into the beam 31 on the side wall 29.

The pipe 45′ connects with a vertical pipe 48 fixed to side wall 30 and pipe 48 connected with beam 31, to provide a passageway from the rear engine 24 exhaust pipe 44 through pipe 45′ to vertical pipe 48 into beam 31′ on the side wall 30.

The heated exhaust from the rear engine of the scraper heats the side walls 29 and 30 of the scraper by the exhaust traveling from the engine to the side walls as follows:

The side wall 29 of the receptacle is heated by the heated exhaust fumes of the rear engine traveling up the exhaust pipe 44 and by half of the hot exhaust fumes traveling along pipe 45 into vertical pipe 47 and then down into beam 31 of the side wall 29. The heated exhaust fumes then travel diagonally down beam 31. The beam 31 has an opening 49 which allows fumes to travel from beam 31 into the hollow compartment 50 forced by panel 36 and circulates in the compartment 50 and then travel out of compartment 50 through opening 51 and 52 of beam 31 and across the lower portion of the compartment 53 formed by panel 37 into beam 33 by an opening 54 in beam 32. A baffle plate 55 is fixed to side wall 29 and is fixed to beam 31 and 32 to channel the heated exhaust fumes across from beam 31 into beam 32.

Some of the heated exhaust traveling down beam 31, will not travel out of beam 31 at opening 49 into compartment 50, but will continue down beam 31 until it rejoins the exhaust fumes traveling out of compartment 50 across to beam 32.

Whereupon the heated exhaust fumes will travel up beam 32. Some of the heated exhaust fumes will travel out of beam 32 through an opening 56 into the upper portion of compartment 53 and circulate in the compartment and then travel out of the upper portion of compartment 53 into beam 33 through an opening 57 in beam 33.

Also, some of the heated exhaust fumes will travel up beam 32 and out of beam 32 through an opening 58 into beam 32 into beam 33 and rearwardly along beam 33. The heated exhaust fumes coming out of the upper portion of compartment 53 through beam 33 through opening 57 will rejoin together with the exhaust fumes travelling rearwardly in beam 33 and will travel out of beam 33 through opening 59 in beam 33 into compartment 38 and circulate in compartment 38 and travel out of compartment 38 through the outlet pipe 43 into the atmosphere outside the scraper.

The heated exhaust fumes will heat side wall 29 by travelling through the compartments and hollow beam along side wall 29 of the scraper and will heat the side wall 29 as just described and as indicated by arrows in FIGS. 1, 2, 3 and 4.

The other side wall 30 of scraper is heated in the same manner in opposite relation approximately the other half of the heat exhaust fumes from the engine coming up from pipe 44 travelling down the diagonal pipe 45' into the vertical pipe 48 and down into beam 31' of the side wall 30. Then the heated exhaust fumes travel diagonally down beam 31' out of the beam 31' through an opening 49' in beam 31' and into compartment 50' and circulates in the compartment and then travels out compartment 50' through openings 51' and 52' in beam 31 across the lower portion of compartment 53' through an opening 54' into two diagonal beams 32'. Some of the heated exhaust travelling down beam 31, will not travel out of beam 31 at opening 49 into compartment 50, but will continue down beam 31 until it rejoins the exhaust fumes travelling out of compartment 50 across to beam 32. A baffle plate 55' is provided which is fixed to side wall 30 and to beams 31' and 32' to channel the heated exhaust from compartment 50' through beam 31' across to beam 32'. The heated exhaust then travels upward along beam 32'. A part of the exhaust travels out of beam 32' through an opening 56' in beam 32' and into compartment 53 and circulates in compartment 53' and then travels out of compartment 53' through an opening 57' in beam 33' into beam 33'. The rest of the exhaust travels up along beam 32' and travels out of beam 32 through an opening 54' into beam 33' and travels rearwardly along beam 33' where it joins with the exhaust leaving compartment 53' through an opening 57' in the beam 33' and the exhaust travels upward through an opening 59' in beam 33' and into compartment 38' where it circulates in compartment 38' and travels out of the compartment 38' through the opening 42' in the compartment into the atmosphere outside the scraper.

Figure 3:
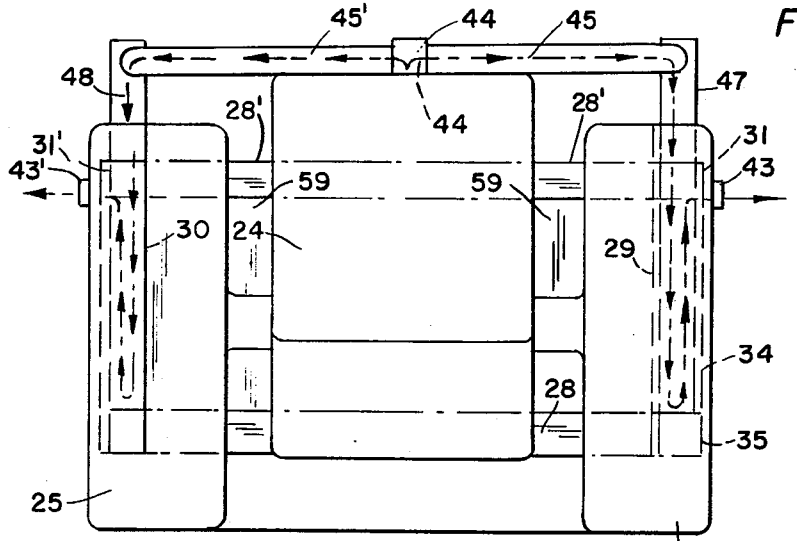
FIG. 3 is a rear elevational view of the scraper having receptacle side walls which are heated.
Figure 6:
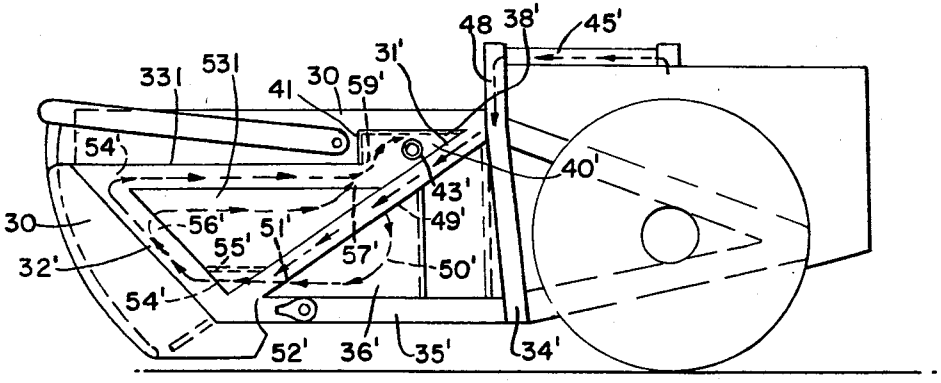
FIG. 6 is an opposing side elevational view of the rear portion of the scraper illustrating the construction of the heated wall of the scraper on the opposite left side thereof.
Figure 7:
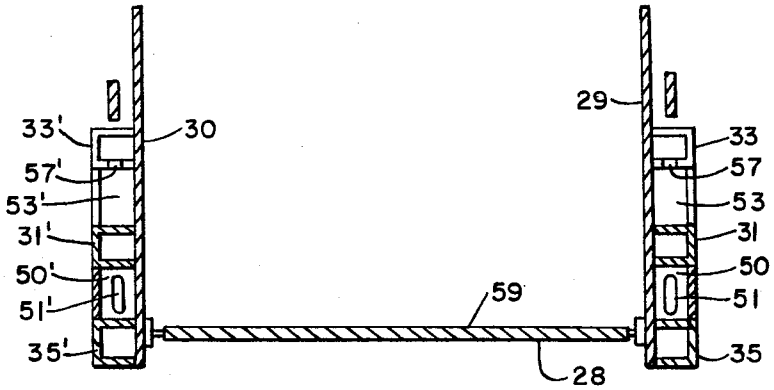
FIG. 7 is a cross-sectional view of the scraper taken along line 7—7 of FIG. 4.

Thus, the heated exhaust will heat the opposing side wall 30 by travelling through compartments along side wall 30 of the scraper as just described and as indicated by the arrows in FIGS. 1, 3, and 6.

The compartment structure on each side wall 29 and 30 channels of the heated exhaust to cause or force the heated exhaust to travel over major portions of the side walls 29 and 30 before the heated exhaust can travel out of the outlet spout of the side walls.

Also, the piping and compartments and channeling is constructed essentially airtight so that the heat exhaust will not leak out to the atmosphere until the heat exhaust reaches the outlet spouts.

The scraper has a conventional ejection or unloading plate 59 pivotally mounted to the bottom wall 28 by pins 60 and 60' in a conventional manner and a conventional cover plate 61 pivotally mounted to the front of the receptacle to open and close the front of the receptacle.

The unloading plate is operated by a hydraulic cylinder 62 which cylinder is pivoted to the rear frame at pivot point 62' and has a piston 63. A lateral arm 63' is pivoted to the rear lateral beam 28' of the receptacle at pivot point 64. A roller 63''' rotatably mounted to the outer end of the lateral arm. The piston 63 is pivotally mounted to the lateral arm 63' at pivot point 64'. The actuation of cylinder 62 pushes the piston 63 from left to right which pivots the lateral arm 63' counterclockwise upward causing the roller 63''' to engage against the unloading plate to pivot the unloading plate clockwise forward for unloading.

The cover plate 61 has a pair of arms 66 and 66' fixed at one end to the cover plate and which are pivotally mounted to the side walls 29 and 30 of the receptacle at the other end to 67''' providing a pivotal mounting for the cover plate. A hydraulic cylinder 66 and lever arm 67 and connection rod 68 act to raise and lower the cover plate.

The lever arm 67 is pivotally mounted at its one end to the front frame. The connecting rod 68 is pivotally mounted to the lever arm at pivot point 69 and is pivotally mounted to the cover plate at its other end. The hydraulic cylinder 66 has its cylinder portion pivotally mounted to the front frame and its piston 66' pivotally mounted to the lever arm at pivot point 70. Whereby actuation of the cylinder 66 pushes the piston 66' upward pivoting the lever arm 67 upward about its pivotal mounting 67' thereby raising the connecting rod upward to raise the cover plate upward.

A pair of arms 71 and 72 have their one ends 73 pivotally mounted to the side beams 34 of the receptacle and the other end fixedly mounted to the side of the front frame. Also, there is a conventional pivotal connection between a front and rear portion of the front frame about a verticle axis not shown.

The operation of the ejection or unloading plate and the cover plate is conventional and well known in the art and hence it is only briefly described.

A conventional cutting edge 73 is fixed to the lower edge of the front of the receptacle.

Figure 4:
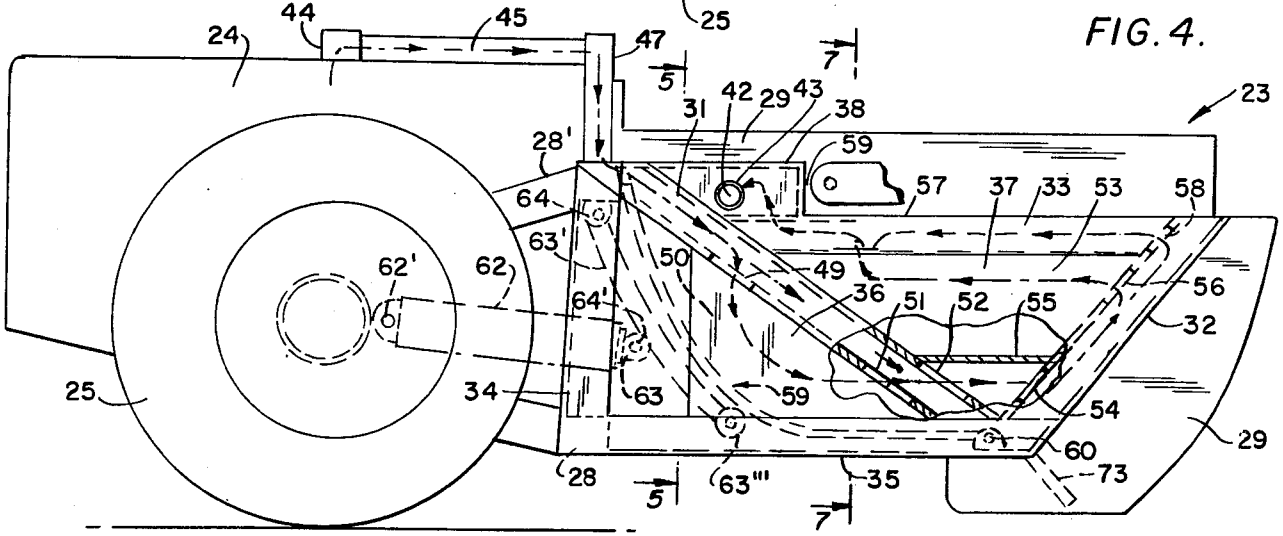
FIG. 4 is an enlarged right side elevational view fragmentary view of the receptacle portion of the scraper.

While loading dirt or earth into the receptacle, the unloading plate will be in its position shown in solid lines in FIGS. 1, 2, and 4 and the cover plate will be raised by the hydraulic cylinder to allow the dirt to come in and onto the unloading plate from the open front of the receptacle. After the dirt has been loaded onto the unloading plate the cover plate will be lowered back to its position shown in solid lines in FIGS. 1, 2, and 4.

When unloading dirt in the receptacle on top of the unloading plate, the cover plate will first be raised by the hydraulic cylinder and the hydraulic cylinder will be activated to pivot the unloading plate clockwise forward from its position shown in solid lines to tip the dirt off the unloading plate out throug the open front of the receptacle.

When operating a conventional scraper in very cold sub zero weather, it has been found that moisture or frost in the dirt loaded on top of the unloading plate and lodged between the side walls of the receptacle and the reloading plate will freeze the dirt and unloading plate and side wall together locking the unloading plate to the side wall making the ejection plate or unloading plate inoperative.

It has been found that the unloading plate is frozen so solidly to the side walls in very cold weather in some instances, that when attempting to free the unloading plate by actuation of the cylinder the piston will simply push the unloading plate horizontally forward ripping the unloading plate from its pivotal mounting.

It has also been found that the moisture or frost in the dirt between the cover plate and side walls of the receptacle, in very cold sub zero weather, will freeze the cover plate to the side wall of the receptacle of a conventional scraper.

By the compartments in the scraper construction and piping heated exhaust from the rear engine into the compartments in the side walls of the receptacle for circulating the heated exhaust in the compartments, the side walls are maintained sufficiently warm in even extremely cold sub zero weather so that the unloading plate and cover plate will not freeze to the receptacle and consequently the scraper can be operated freely in extremely cold sub zero weather without the unloading or ejection plate or cover plate freezing or locking to the side walls.

It has also been found that when the scraper has been turned off and that even if the dirt may have frozen the ejection plate and/or the cover plate to the side walls of the receptacle, that by starting the rear engine and allowing the heated exhaust to flow from the exhaust pipe of the rear engine through the compartment of the side walls and out the outlet spout for a reasonable length of time, it will warm the side walls sufficiently to warm the dirt and melt the frost in the dirt between the edges of the ejection plate and cover plate and side walls so that the cover plate and unloading plate or ejection plate will be free to move. It will maintain the side walls sufficiently warm thereafter.

The compartments on the side walls of the receptacle may be enlarged if desired, for example, by enlarging the compartments 50 and 50' rearwardly. It has further been found that the heated exhaust does not have to directly contact all of the surfaces of the side walls as long as the heated exhaust travels a number of paths so that the wall surfaces are either in direct contact with the heated exhaust or are sufficiently close to the path of the heated exhaust that the heat from the exhaust travels by convection in the remainder of the surfaces of the side wall.

While the invention has been illustrated in connection with a conduit construction which conveys or carries the heated exhaust from the rear engine of the scraper to the side walls of the receptacle of the scraper, it is understood that a conduit construction could be provided for scrapers to pipe the heated exhaust from the front engine to the compartments of the receptacle by providing a suitable swivel connection in the piping where the front and rear frames are connected together and which would be necessary for scrapers to have only a front engine.

It will be obvious that various changes and departures may be made to the invention without departing from the spirit and scope thereof and accordingly it is not intended that the invention be limited to that specifically described in the specification or as illustrated in the drawings but only as set forth in the appended claims wherein.

What is claimed is:

1. A scraper device comprising a front and rear frame, an engine fixed on said rear frame, an elongated receptacle fixed on said rear frame in front of said engine, said engine having an exhaust outlet, said receptacle having side walls, a back wall, a cover plate to cover the front of said receptacle, and an unloading plate movably mounted within said receptacle for unloading earth from within said receptacle, said side walls each having a vertical inner panel having smooth inner surfaces, lateral rib members mounted to the outside of said inner panel to form outward extending ridges, outer panel means parallel to said inner panel means and spaced outwardly therefrom and connecting said ribs together at their outer edges to form substantially one air tight compartment on each side wall, said substantially one air tight compartment on each side wall covering a major portion of the area of each inner side wall, said substantially one air tight compartment having an inlet port, said ribs having ports to provide communication throughout the interior of each of said air tight compartments, each of said substantially one air tight compartments having an outlet port, pipe means connecting said exhaust outlet of said engine to said inlet ports of said air tight compartments, said unloading plate being movable to move from rear to front along said inner side wall panels for said unloading whereby heated exhaust from said engine piped from said engine exhaust outlet through said pipe means to each of said substantially one air tight compartments on each side wall will be caused to travel through said compartments to directly heat a major portion of the inner wall of each side wall by the heat of said exhaust before the heated exhaust will travel out of said air tight compartments through the outlet pipe to keep a major portion of the side walls sufficiently heated to prevent any moisture in the earth in the receptacle located between the unloading plate and the inner side walls from freezing and locking the unloading plate to the inner side wall panels during sub zero weather.

* * * * *